US008106607B2

(12) United States Patent
Pope

(10) Patent No.: US 8,106,607 B2
(45) Date of Patent: Jan. 31, 2012

(54) NETWORK MASTER FOR WIRELESS FLUORESCENT LAMP LIGHTING CONTROL NETWORKS

(75) Inventor: Steven M. Pope, Los Gatos, CA (US)

(73) Assignee: IXYS CH GmbH (CH)

( * ) Notice: Subject to any disclaimer, the term of this patent is extended or adjusted under 35 U.S.C. 154(b) by 328 days.

(21) Appl. No.: 12/590,084

(22) Filed: Oct. 30, 2009

(65) Prior Publication Data

US 2011/0101869 A1 May 5, 2011

(51) Int. Cl.
*H05B 37/00* (2006.01)

(52) U.S. Cl. ..... 315/318; 315/312; 315/294; 315/309; 340/538.15; 340/539.11; 340/426.25; 375/219

(58) Field of Classification Search ..... 315/318, 315/312, 294, 295, 308, 309; 340/426.2, 340/426.25, 539.1, 539.11, 538.15; 375/219, 375/135, 136, 138

See application file for complete search history.

(56) References Cited

U.S. PATENT DOCUMENTS 5,726,644 A * 3/1998 Jednacz et al. ..... 340/9.14
6,693,535 B2 * 2/2004 Van Bosch et al. ..... 340/539.1
7,884,727 B2 * 2/2011 Tran ..... 340/573.1
2006/0044152 A1 * 3/2006 Wang ..... 340/825
2011/0074623 A1 * 3/2011 Baker ..... 342/175
2011/0076950 A1 * 3/2011 Pope ..... 455/41.3
2011/0080091 A1 * 4/2011 Staab et al. ..... 315/61
2011/0080106 A1 * 4/2011 Khalsa et al. ..... 315/250
2011/0080107 A1 * 4/2011 Khalsa et al. ..... 315/250

* cited by examiner

*Primary Examiner* — Haiss Philogene
(74) *Attorney, Agent, or Firm* — Imperium Patent Works; T. Lester Wallace

(57) ABSTRACT

A system involves a plurality of RF-enabled occupancy detectors. Each occupancy detector communicates with and controls an associated plurality of RF-enabled fluorescent lamp starter units. A network master has an RF transceiver used to communicate with the occupancy detectors using a first protocol, thereby retrieving status information from the starter units. The network master also has a second RF transceiver for communicating directly with a cellular telephone using a second protocol. A user can use the cellular telephone to control and interact with the lighting system through the network master, and/or to retrieve status information from the network master. The network master automatically generates and sends email alerts to the user by sending the alerts to an email server. The email server forwards the emails to the cellular telephone via a cellular telephone network. Alerts may, for example, indicate a low battery voltage condition or that a lamp needs replacement.

20 Claims, 9 Drawing Sheets

RF-ENABLED
STARTER UNIT

RF-ENABLED
STARTER UNIT

INITIAL CONDITION

PREHEATING

HIGH VOLTAGE

IGNITION AND USAGE

TURN OFF - STEP ONE

TURN OFF - STEP TWO

TURN OFF - STEP THREE

TURN OFF COMPLETE

NETWORK MASTER FOR WIRELESS FLUORESCENT LAMP LIGHTING CONTROL NETWORKS

TECHNICAL FIELD

The described embodiments relate to wireless lighting control networks, and more particularly to a device for collecting and storing and reporting status information from wireless lighting control networks.

BACKGROUND INFORMATION

A wireless lighting control system has been proposed that involves a battery-powered occupancy detector and a plurality of fluorescent lamp starter units. The occupancy detector has a Radio Frequency (RF) transceiver for communication with similar RF transceivers of the fluorescent lamp starter units. Each fluorescent lamp starter unit is coupled to an associated fluorescent lamp so that the starter unit can turn on and turn off the lamp. If the occupancy detector detects motion in a room illuminated by the fluorescent lamps, then the occupancy detector in the room transmits RF communications to the fluorescent starter units such that the fluorescent lamps are turned on and/or remain on to keep the room illuminated. If motion is then not detected in the room, then the occupancy detector transmits RF communications to the fluorescent starter units such that the fluorescent lamps are turned off to conserve energy. In one application, there are multiple such occupancy detector/fluorescent starter unit networks operating at the same time in the same operating environment. For example, one such occupancy detector/fluorescent starter unit network may be operating in each of a plurality of rooms of a building. Systems and methods for making these proposed networks more useful and cost effective are desired.

SUMMARY

A wireless lighting control system involves a plurality of RF-enabled occupancy detectors. Each RF-enabled occupancy detector communicates with and controls an associated plurality of RF-enabled fluorescent lamp starter units. A novel network master has a first RF transceiver usable to communicate with the occupancy detectors using a first protocol, thereby retrieving status information onto the network master from the occupancy detectors. The status information may relate to the occupancy detectors and/or to the fluorescent lamp starter units. In one example, the first protocol is an 868 MHz FSK low-power time-hopping wireless network protocol.

The novel network master also has a second RF transceiver for communicating directly with a cellular telephone using a second protocol. The second protocol is not a cellular telephone protocol and may, for example, be the 802.11(n) protocol. The second RF transceiver and second protocol is also usable to communicate with an Internet-connected local router.

A user can use the cellular telephone to control and interact with the lighting system through the network master, and/or to retrieve system status information from the network master. The network master automatically generates and sends email alerts to the user by sending the alerts to an email server on the Internet. The alert is sent out of the network master using the second RF transceiver and the second protocol. The email passes through the Internet-connected local router and to the email server. The email server in turn forwards the email alert to the cellular telephone via a cellular telephone network. Email alerts may, for example, indicate that a battery of an identified occupancy detector needs replacement or that a lamp controlled by a particular starter unit needs replacement.

By collecting and storing historical status information in the one network master, the amount of memory required in each of the multiple occupancy detectors that would otherwise be required to collect and store the historical status information in the system is reduced. The manufacturing cost of the occupancy detectors is thereby reduced. Although the status information is presented to the user in a rich graphical user interface presentation, the network master does not serve web pages. The network master also does not have a display or a keypad or keyboard. To report status information to the user, the network master only needs to supply the status information to the cellular telephone in relatively short TCP/IP packets. The memory and processing capabilities of the cellular telephone that receives these packets are then used to process and to present the status information to the user in a pleasing and useful way and to otherwise interact with the user using a rich graphical user interface.

Further details and embodiments and techniques and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to background examples and some embodiments of the invention, examples of which are illustrated in the accompanying drawings.

Figure 1:
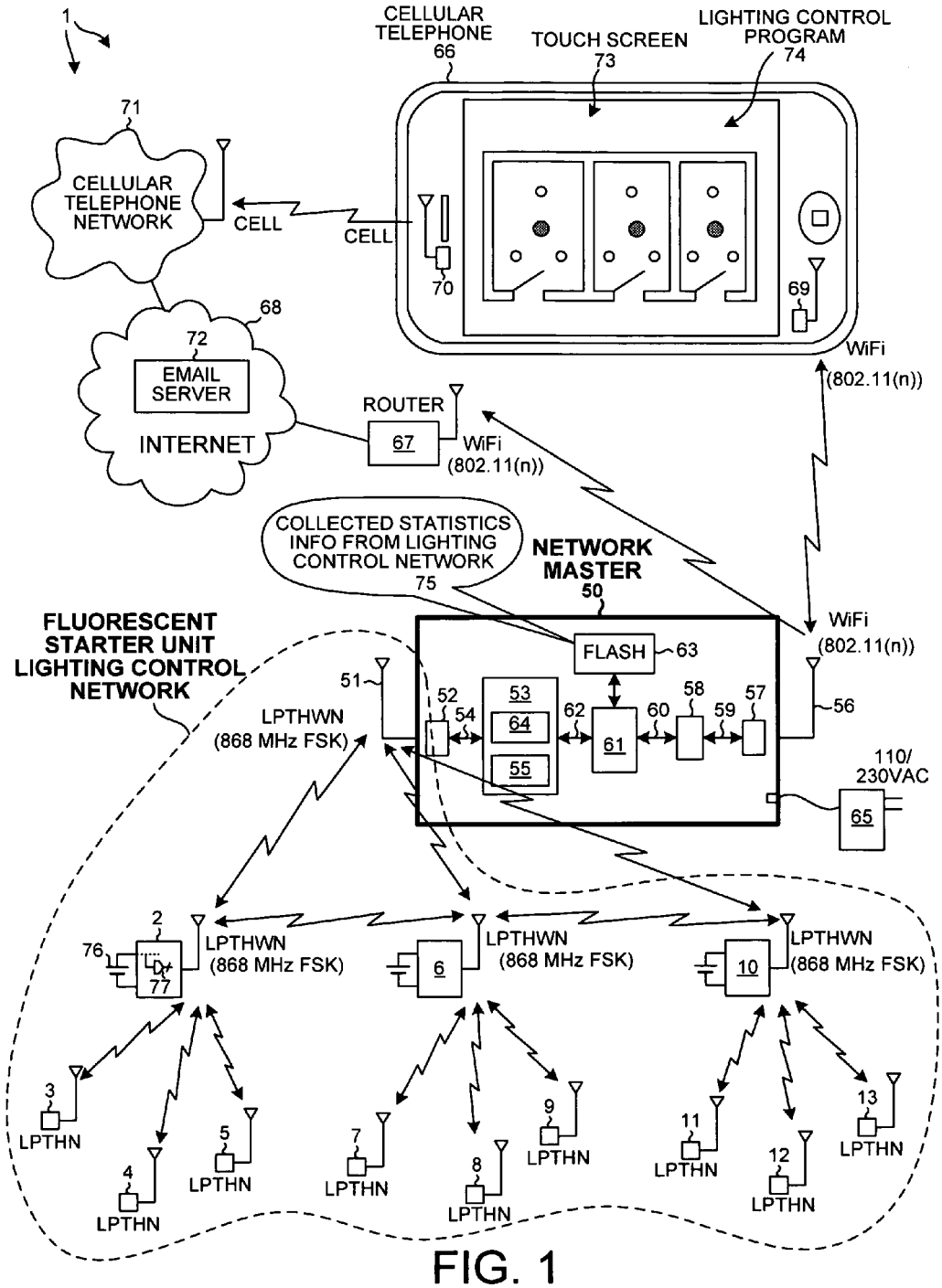
FIG. 1 is a diagram of a fluorescent lamp lighting control system 1 involving a novel network master.

FIG. 1 is a diagram of a system 1 in accordance with one novel aspect. A first low-power time-hopping wireless network (LPTHWN) includes a first battery-powered Passive InfraRed (PIR) occupancy detector 2 and a first plurality of wireless fluorescent lamp starter units 3-5. A second low-power time-hopping wireless network includes a second battery-powered PIR occupancy detector 6 and a second plurality of wireless fluorescent lamp starter units 7-9. A third low-power time-hopping wireless network includes a third battery-powered PIR occupancy detector 10 and a third plurality of fluorescent lamp starter units 11-13. Although each network includes only three fluorescent lamp starter units in the system pictured, a network may include multiple occupancy detectors and many more starter units. In each of the networks, communication between the starter units and the occupancy detector is synchronous with respect to a stream of adjacent 800 millisecond (MS) intervals of time. Each 800 ms interval has a 5 ms beacon slot time during which the occupancy detector can transmit a beacon. Although an occupancy detector can transmit beacons more frequently, each occupancy detector typically only transmits one beacon in each 256th interval. In the vast majority of 800 ms intervals, no beacon is transmitted. The starter units of a network use the beacons of the occupancy detector of the network to synchronize when they wake up and place their RF transceivers into a receive mode. The synchronization occurs such that the RF transceivers of the starter units are in the receive mode during the beacon slot times so that if the occupancy detector were to transmit a beacon during a beacon slot time of an 800 ms interval then the starter units would receive the beacon. The starter units wake up and listen for a beacon during the beacon slot time of each 800 ms interval, regardless of whether the occupancy detector transmits a beacon during that interval or not. An occupancy detector can place a command in a beacon. The command instructs a particular starter unit to transmit back information shortly after the beacon time. In this fashion, the occupancy detector commands the starter units one by one to transmit information back to the occupancy detector. Accordingly, low bandwidth bidirectional communication occurs between the starter units and the occupancy detector of each LPTHWN. For additional information on the LPTHNs, the occupancy detectors, and the starter units, and how these devices are made and used, see: 1) U.S. patent application Ser. No. 12/587,152, entitled "Registering A Replaceable RF-Enabled Lamp Starter Units To A Master Unit", filed Oct. 1, 2009; 2) U.S. patent application Ser. No. 12/587,130, entitled "Turning Off Multiple Fluorescent Lamps Using RF-Enabled Lamp Starter Units", filed Oct. 3, 2009; 3) U.S. patent application Ser. No. 12/587,169, entitled "Dimming A Multi-Lamp Fluorescent Light Fixture By Turning Off An Individual Lamp Using A Wireless Fluorescent Lamp Starter", filed Oct. 3, 2009; 4) U.S. patent application Ser. No. 12/587,062, entitled "Low-Power Wireless Network Beacon For Turning Off And On Fluorescent Lamps", filed Sep. 30, 2009; and 5) U.S. patent application Ser. No. 12/587,106, entitled "Time-Hopping Low-Power Wireless Network For Turning Off And On Fluorescent Lamps", filed Sep. 30, 2009 (the entire subject matter of the above-listed five patent applications is incorporated herein by reference).

Figure 2:
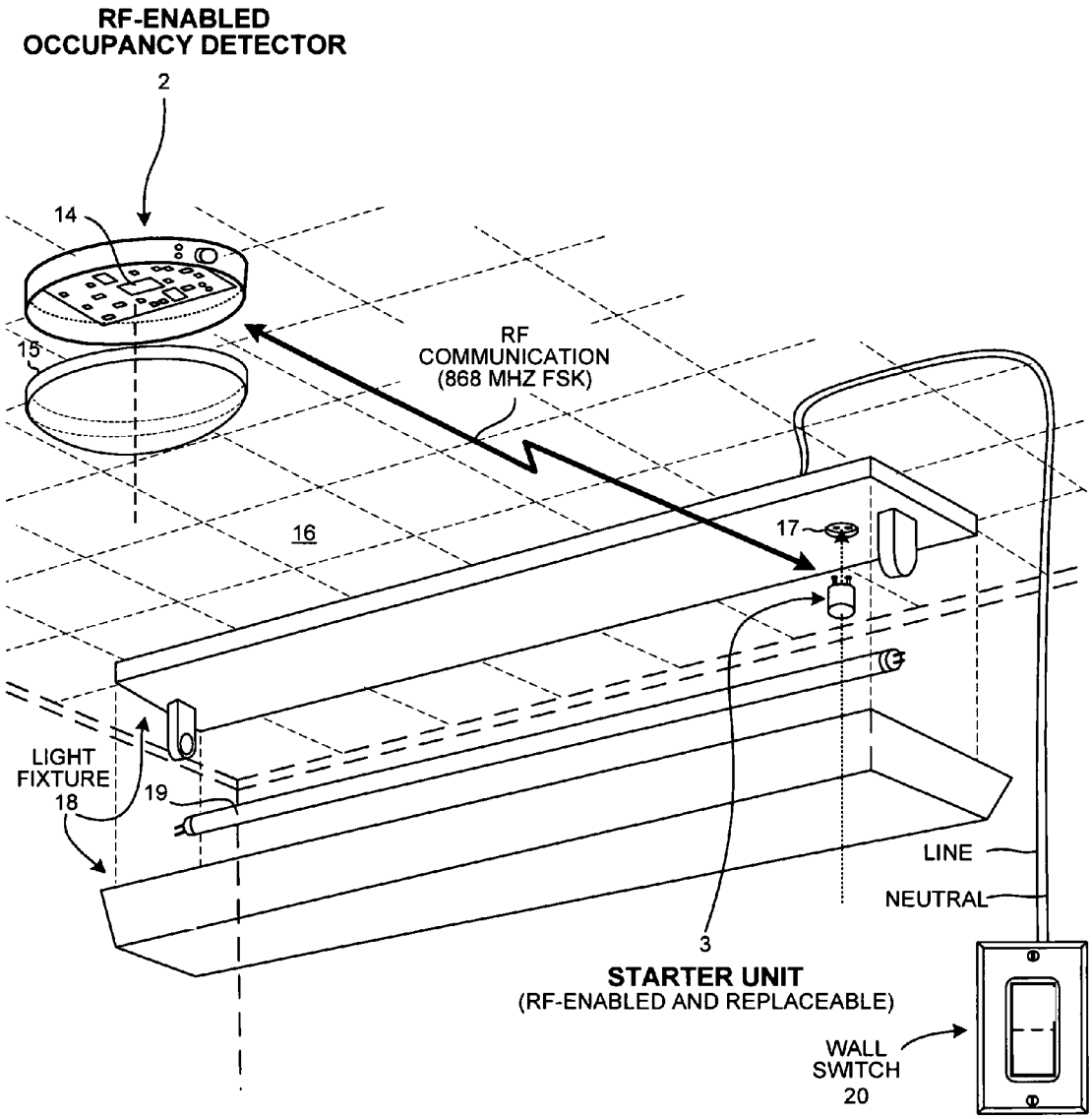
FIG. 2 is a diagram of one of the RF-enabled occupancy detectors 2 and one of the RF-enabled starter units 3 of system 1 of FIG. 1.

FIG. 2 is a perspective view that illustrates one such occupancy detector 2 and one starter unit 3. Occupancy detector 2 includes a PIR motion sensor 14, a fresnel lens 15, and radio circuitry. Occupancy detector 2 in the illustrated example is attached to the ceiling 16 of the room that contains starter unit 3. Starter unit 3 is a replaceable RF-enabled starter unit that plugs into an accommodating socket 17 in a fluorescent light fixture 18. If a wall switch 20 is in a first position, then fixture 18 is not energized by the line and neutral wires, and the electronics in the starter unit 3 is unpowered and does not operate. Lamp 19 is unpowered and is off. If the light wall switch 20 is in a second position, then fixture 18 is energized by the line and neutral wires. Electronics in starter unit 3 is powered. Starter unit 3 in this condition may be controlled, via RF communications from occupancy detector 2, to turn lamp 19 on or off. In normal operation of the network, wall switch 20 is left in this second position so that the starter unit can turn off fluorescent lamp 19 when appropriate to save electrical energy.

Figures 3, 4:
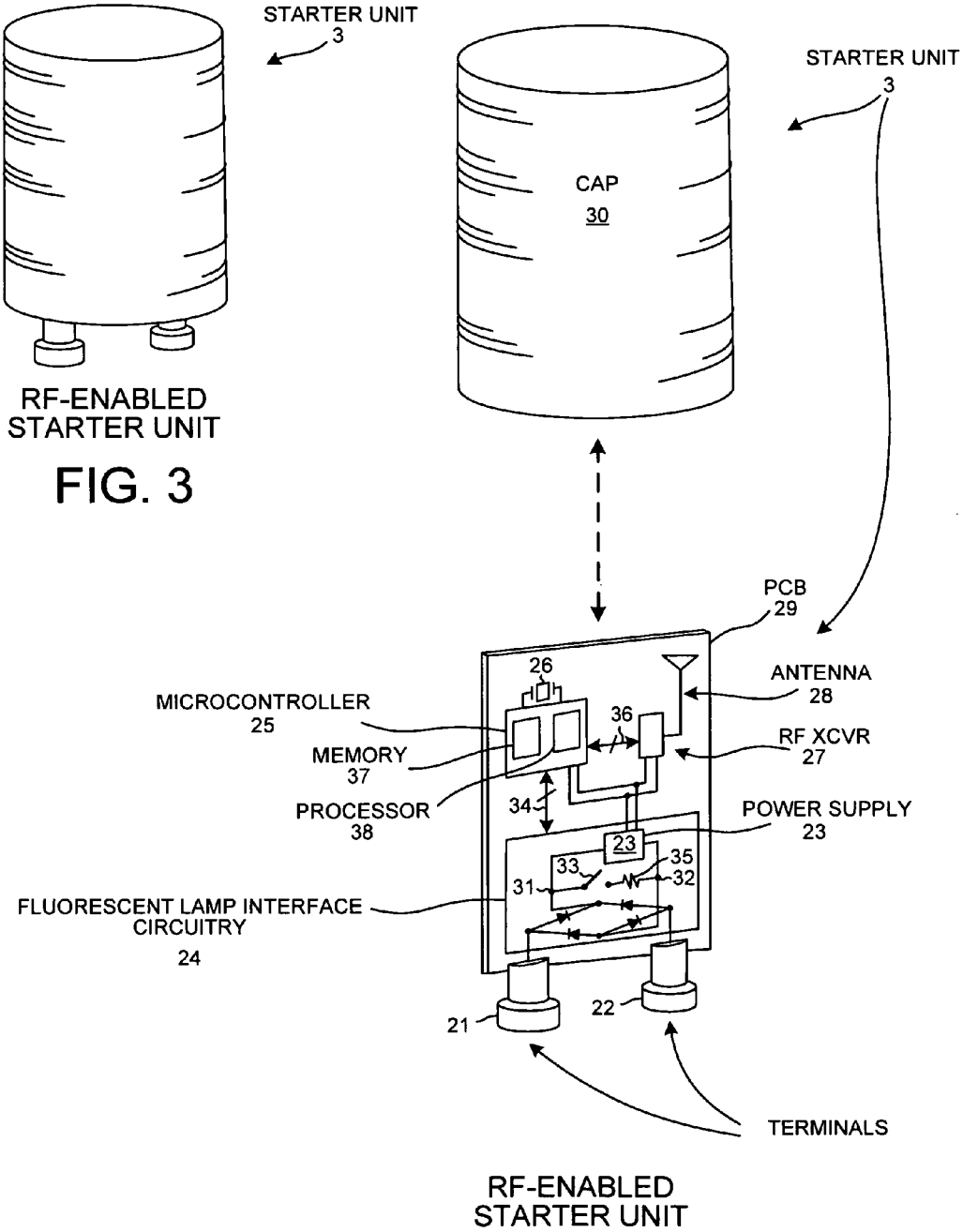
FIG. 3 is perspective view of the RF-enabled starter unit 3 of FIG. 2.
FIG. 4 is an exploded perspective view of the RF-enabled starter unit 3 of FIG. 3.

FIG. 3 is a perspective view of starter unit 3. FIG. 4 is an exploded view of starter unit 3. Starter unit 3 includes a first terminal 21, a second terminal 22, a power supply circuit 23, fluorescent lamp interface circuitry 24, a microcontroller integrated circuit 25, a 32.768 kHz crystal 26, an RF transceiver integrated circuit 27, and an antenna 28. This circuitry is disposed on a printed circuit board (PCB) 29 as illustrated. PCB 29 is disposed within a cylindrical cap 30. Terminals 21 and 22 extend downward through holes in a circular disk-shaped base portion (not shown) of PCB material. The circular edge of this disk-shaped base portion joins with the circular bottom edge of cap 30 and forms a circular bottom of starter unit 3.

Fluorescent lamp interface circuitry 24 includes a full wave rectifier that receives a 230 VAC signal between terminals 21 and 22 and outputs a full wave rectified signal between nodes 31 and 32. Power supply circuit 23 receives the full wave rectified signal between nodes 31 and 32 and generates therefrom a direct current (DC) supply voltage VDD used to power microcontroller 25, RF transceiver 27, and interface circuitry 24. Power switch 33 is a switch that is used to turn on, and to turn off, fluorescent lamp 19. Power switch 33 is a power Field Effect Transistor (FET) that is controlled by microcontroller 25 via gate drive circuitry of circuitry 24. Microcontroller 25 drives the gate of switch 33 and controls and monitors the remainder of interface circuitry 24 via signals communicated across conductors 34. Microcontroller 25 monitors and traces the AC voltage waveform between nodes 31 and 32 using an Analog-to-Digital Converter (ADC) that is part of the microcontroller. Microcontroller 25 monitors and traces the waveform of the current flowing through switch 33 by using its ADC to monitor a voltage dropped across a sense resistor 35. Microcontroller 25 uses an on-board comparator and timer to detect and time zero-crossings of the AC signal on terminals 31 and 32. Microcontroller 25 determines when and how to control switch 33 based on the detected AC voltage between nodes 31 and 32, the time of the zero-crossings of the AC signal on terminals 21 and 22, and the magnitude of current flow through switch 33.

Crystal 26 is a 30 ppm (parts per million) accuracy 32.768 kHz crystal that is used to generate an accurate time base for the timer within microcontroller 25. This timer is used not only to monitor the AC voltage waveform on nodes 31 and 32, but it is also used to control and to time other starter unit operations such as the timing of when beacons are transmitted, the timing of when the RF transceiver is placed into the receive mode, and the timing of when the starter unit circuitry is placed into a low-power sleep mode. Execution of instructions by the microcontroller, on the other hand, is clocked by a relatively less accurate 1.3824 MHz clock signal generated by a four percent accuracy Internal Precision Oscillator (IPO) that is internal to the microcontroller integrated circuit.

Microcontroller 25 communicates with and controls RF transceiver 27 via a bidirectional serial SPI bus and serial bus conductors 36. In one embodiment, microcontroller 25 is a Z8F2480 8-bit microcontroller integrated circuit available from Zilog, Inc., 6800 Santa Teresa Blvd., San Jose, Calif. 95119. Microcontroller 25 includes an amount of non-volatile memory (FLASH memory) 37 that can be written to and read from by processor 38 under software control during operation of starter unit 3. Flash memory 37 stores program code executed by processor 38 to implement the time-hopping protocol used to communicate with occupancy detector 2, as well as to store parameters and configuration information specific to starter unit 3. In one embodiment, RF transceiver 27 is a SX1211 transceiver integrated circuit available from Semtech Corporation, 200 Flynn Road, Camarillo, Calif. 93012. Transceiver 27 in sleep mode consumes about 2 uA of supply current, whereas transceiver 27 in receive mode consumes about 3.5 mA of supply current and in transmit mode consumes about 25 mA of supply current. Transceiver 27 is coupled to antenna 28 via an impedance matching network (not shown) and a SAW filter (not shown). The SAW filter may, for example, be a B3716 SAW filter available from the Surface Acoustic Wave Components Division of EPCOS AG, P.O. Box 801709, 81617 Munich, Germany. Antenna 28 may, for example, be a fifty ohm 0868AT43A0020 antenna available from Johanson Technology, Inc., 4001 Calle Tecate, Camarillo, Calif. 93012. The RF transceiver operates in a license free frequency band in the 863-878 MHz range (for example, about 868 MHz), in accordance with a reference design available from Semtech Corporation. Microcontroller 25 controls transceiver 27 with minimal power consumption by issuing commands to the transceiver via serial bus 36, setting a timer to wake itself at a proper future time, and then putting itself into a low power mode. In the low power mode the microcontroller consumes approximately 25 microamperes (uA) of supply current whereas the microcontroller consumes approximately 1.4 milliamperes (mA) of supply current when fully active.

Figure 5:
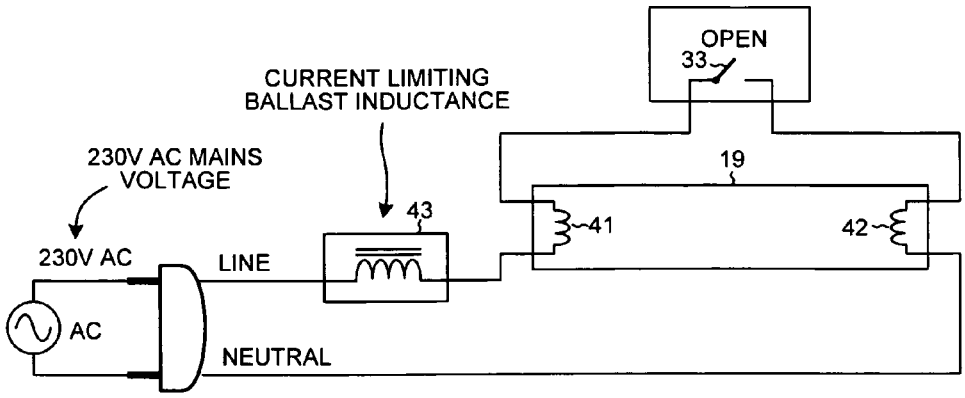
FIGS. 5-8 illustrate how a starter unit can turn on a fluorescent lamp.
Figure 6:
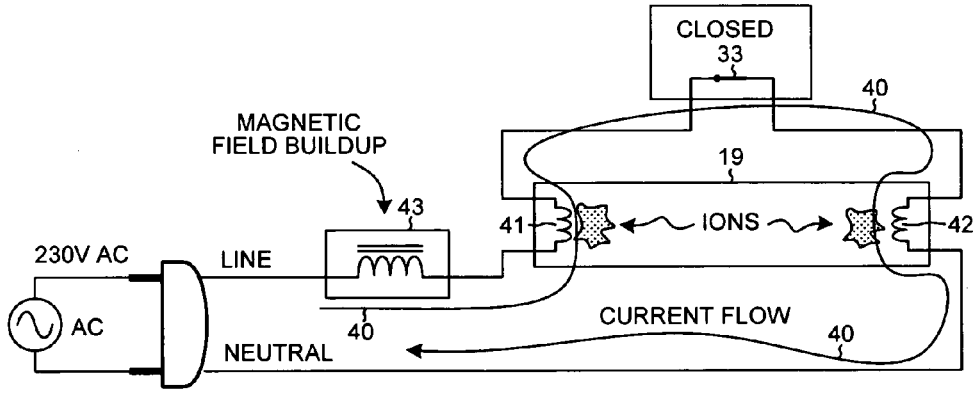
Figure 7:
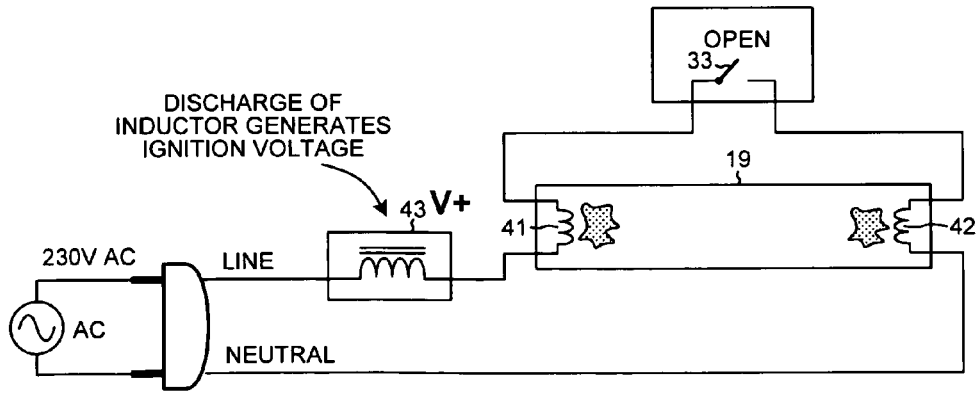
Figure 8:
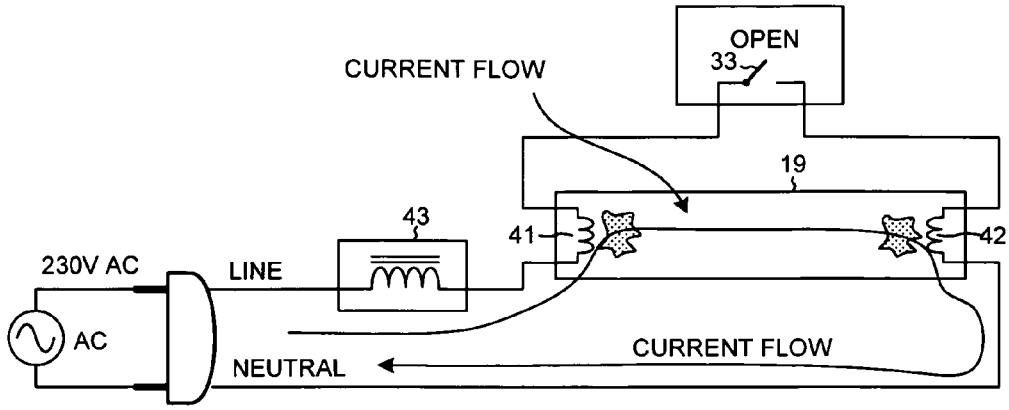

FIGS. 5-8 illustrate how starter unit 3 can turn fluorescent lamp 19 on. FIG. 5 shows an initial condition in which lamp 19 is off. Switch 33 is open so no current flows through lamp 19. FIG. 6 shows a first step in the process. Switch 33 is closed, thereby causing current flow 40. The filaments 41 and 42 heat, and a magnetic field builds in a ballast inductance 43. FIG. 6 shows a second step in the process of turning on the lamp. Switch 33 is opened. The collapsing magnetic field in inductance 43 causes a large voltage to develop across the inductance 43 and between the filaments 41 and 42. FIG. 7 shows a third step in the process of turning on the lamp. The large voltage developed across the inductance 43 is present between the filaments 41 and 42 of the lamp. This voltage causes an arc to form through gas within the lamp. Once the arc forms, the resistance between the two filaments drops, and continued current flow is possible. The continued AC current flow continues to keep the filaments hot such that the arc is maintained and current flow continues. As illustrated in FIG. 8, the fluorescent lamp is then on and switch 33 remains open.

Figure 9:
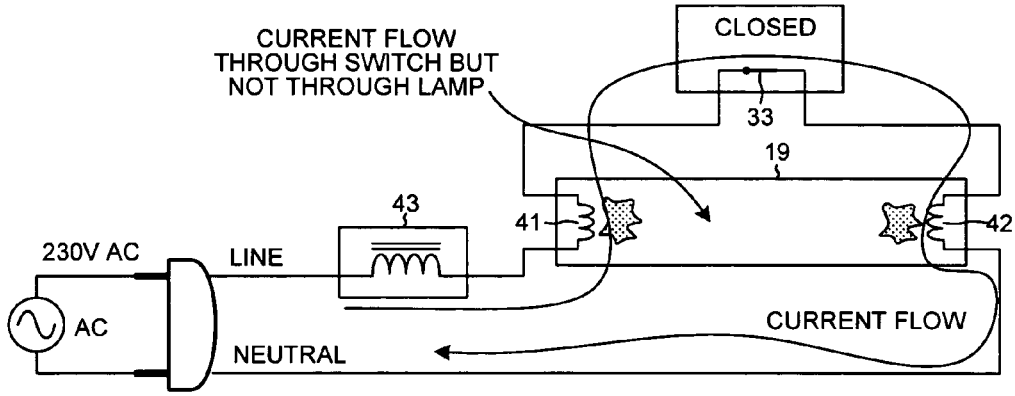
FIGS. 9-12 illustrate how a starter unit can turn off a fluorescent lamp.
Figure 10:
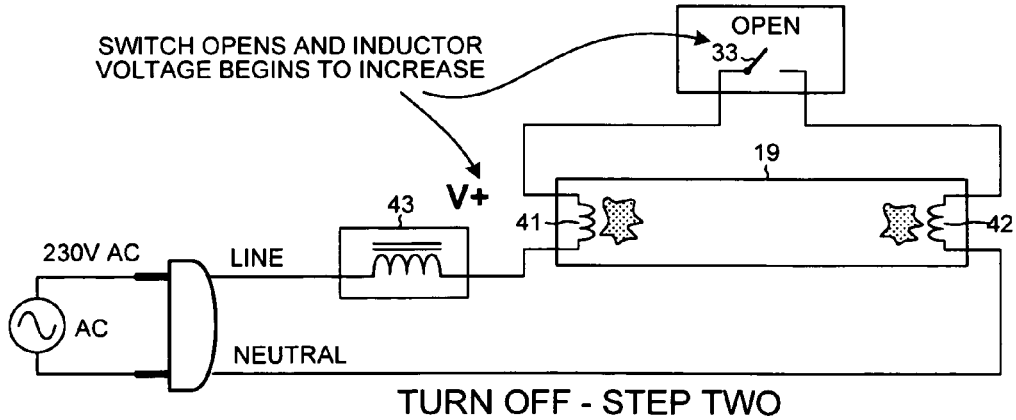
Figure 11:
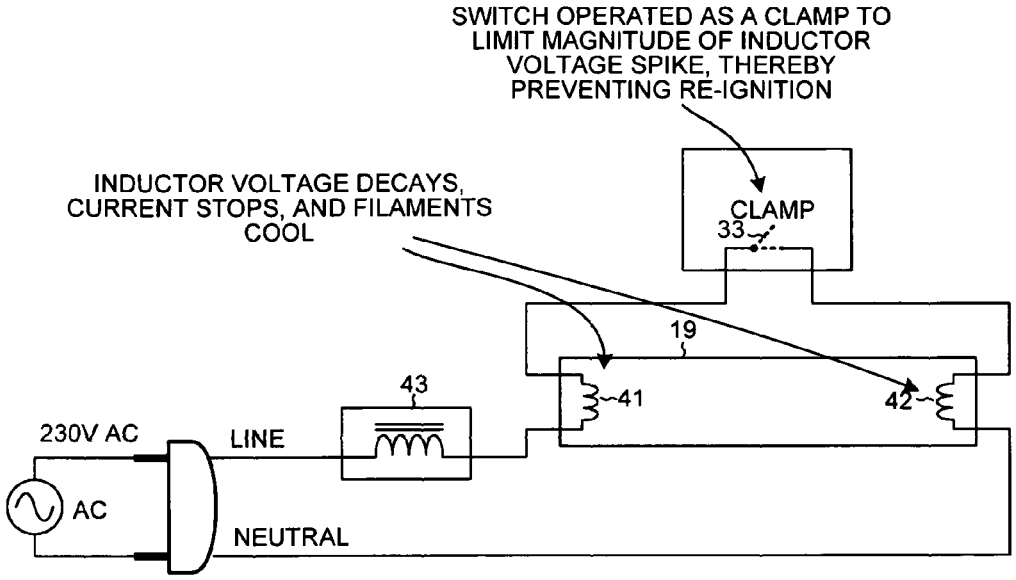
Figure 12:
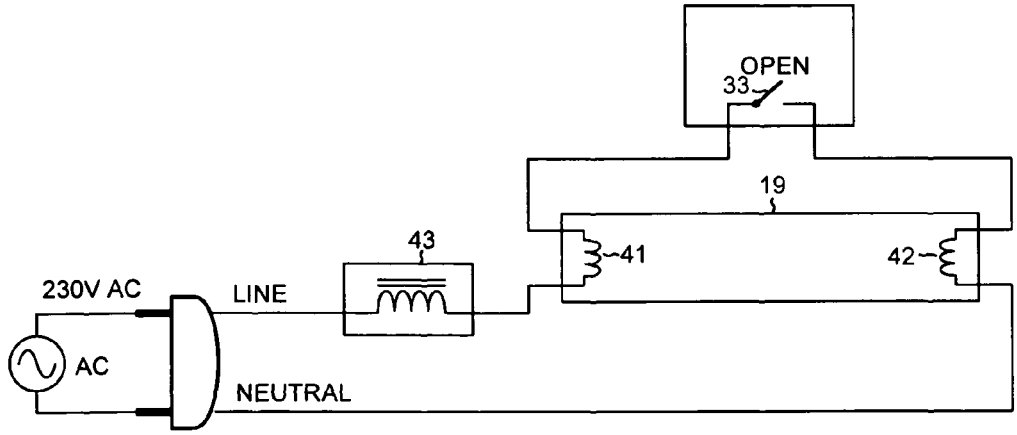

FIGS. 9-12 illustrate how starter unit 3 can turn fluorescent lamp 19 off. Initially, fluorescent lamp 19 is on and the circuit is in the on state illustrated in FIG. 8. Next, switch 33 is closed as illustrated in FIG. 9. Due to switch 33 being closed, current stops flowing between the filaments 41 and 42 of lamp 19 but rather flows through closed switch 33. The arc through the lamp is stopped. Current, however, continues to flow through filaments 41 and 42 and the filaments continue to be heated. Switch 33 can only remain closed in this condition for a short amount of time or the switch will become overheated and will be destroyed. Next, as illustrated in FIG. 10, switch 33 is opened. The cutting of current flow through inductance 43 causes a voltage to start to develop across inductance 43, but before the voltage can increase to the point that an arc is ignited through lamp 19, switch 33 is made to operate as a voltage clamp to limit the magnitude of the voltage spike. Clamp operation of switch 33 is represented in FIG. 11 by showing switch 33 in dashed lines. Due to the clamping action of switch 33, the voltage across inductance 43 is not high enough to ignite an arc through lamp 19, and energy stored in a magnetic field in inductance 43 is dissipated. After enough of the energy stored in inductance 43 has been dissipated and after filaments 41 and 42 have stopped ionizing gas to an adequate degree, then switch 33 is opened on a constant basis without igniting an arc. This condition is illustrated in FIG. 12. There is no current flow, and the filaments 41 and 42 begin to cool. The fluorescent lamp is then said to be in the off condition.

In addition to networks of occupancy detectors and starter units, the system 1 of FIG. 1 further includes a novel network master 50. Network master 50 includes an antenna 51 and an RF transceiver 52 for bidirectional wireless time-hopping communication with the occupancy detectors 2, 6 and 10. In one embodiment, RF transceiver 52 is the same type of transceiver integrated circuit (SX1211 transceiver integrated circuit available from Semtech Corporation, 200 Flynn Road, Camarillo, Calif. 93012) as embodied in the starter units and the occupancy detectors. Network master 50 further includes a microcontroller 53 that is coupled to transceiver 52 via an SPI serial bus 54. In one embodiment, microcontroller 53 is an Encore Z8F1680 8-bit microcontroller integrated circuit available from Zilog, Inc., 6800 Santa Teresa Blvd., San Jose, Calif. 95119. Microcontroller 53 includes an amount of non-volatile memory (FLASH memory) 55. Network master 50 further includes a second antenna 56 and a second RF transceiver 57. Antenna 56 and transceiver 57 are, in one embodiment, an IEEE 802.11(n) WiFi access point that is usable in a stand-alone station mode. In stand-alone station mode, this access point broadcasts an SSID (Service Set Identifier) so an Internet device in RF wireless communication can discover the SSID address and engage in TCP/IP communications with the access point. TCP/IP packets are contained in 802.11 frames. Network master 50 further includes an Ethernet PHY integrated circuit 58 that is coupled to the access point via a transformer-coupled eight-conductor Ethernet connection 59. Ethernet PHY integrated circuit 58 in turn is coupled via an MII interface 60 to a communications microcontroller 61. Communications microcontroller 61 in the present embodiment is a F91 eZ80 Acclaim microcontroller available from Zilog, Inc., 6800 Santa Teresa Blvd., San Jose, Calif. 95119. Communications microcontroller 61 implements a TCP/IP protocol stack usable to receive and transmit TCP/IP communications via WiFi access point 57. In addition, communications microcontroller 61 includes an SMTP protocol functionality usable to generate emails that can be communicated via WiFi access point 57. Communications microcontroller 61 is coupled to microcontroller 53 via an RS-232 serial port 62. An extra amount of FLASH memory 63 is provided for use by communications microcontroller 61. A program 64 of processor-executable instructions executing on microcontroller 53 can communicate with the occupancy detectors 2, 6 and 10 via transceiver 52 and antenna 51. Program 64 can also communicate with internet devices using the TCP/IP protocol. To communicate using the TCP/IP protocol, microcontroller 53 under control of program 64 provides a data payload to communications microcontroller 61. Communications microcontroller 61 in turn forms TCP/IP packets that include the data and sends the TCP/IP packets through Ethernet PHY 58 to WiFi access point 57. WiFI access point 57 packages the packets as 802.11 frames and transmits the frames. Incoming 802.11 frames that contain TCP/IP packets pass in the opposite direction. The frames are received by access point 57, pass through Ethernet PHY 58, and are processed by the TCP/IP stack functionality of communications microcontroller 61. The resulting data is then accessible by microcontroller 53 via serial bus 62. Unlike the battery-powered occupancy detectors 2, 6 and 10, network master 50 is AC line-powered by a 110/230 VAC adapter 65.

Network master 50 functions as a bridge between two wireless networks: 1) the low-power time-hopping wireless networks of the occupancy detectors 2, 6 and 10, and 2) the WiFi network by which network master 50 communicates with other devices (for example, devices 66 and 67). Device 66 is a web-enabled cellular telephone (for example, an iPhone brand cellular telephone available from Apple Computer Inc., 1 Infinite Loop, Cupertino, Calif. 95014). Device 67 is a local WiFi-enabled router that is coupled to the Internet 68. Where, for example, system 1 is deployed in a school or office building, the WiFi enabled router 67 is provided such that students and teachers and office workers having their own wireless portable devices (for example, laptop computers) can have easy local wireless access to a Local Area Network (LAN) and/or the Internet.

Cellular telephone 66 includes a lighting control program 74 referred to here as an "app". In one example, lighting control program 74 is written in the objective C object-oriented programming language using the XCode toolset available from Apple Computer. Using the toolset, program 74 is compiled and loaded into cellular telephone 66 as a bundled application. An operation of program 74 is explained in further detail below.

Cellular telephone 66 has both a WiFi transceiver and communication functionality 69 as well a cellular telephone transceiver and communication functionality 70. In conventional fashion, cellular telephone 66 is usable to make cellular telephone communications by transmitting to and receiving from a cellular telephone network 71. This cellular telephone network 71 is connected to the Internet. Cellular telephone 66 is web-enabled and includes an email application usable to interact in conventional fashion with an email server 72 on the Internet. If, for example, the user of cellular telephone 66 wishes to read a newly received email received for the user onto email server 72, then the user selects an email service icon on the touch screen 73 of cellular telephone 66. This selection causes an email service "app" to be launched. Through cellular telephone network 71, the cellular telephone 66 interacts with email server 72 and retrieves the incoming email. In a similar fashion, cellular telephone 66 is usable to interact with email server 72 such that the user can compose and deposit an email onto the email server 72 that is in turn sent out by email server 72.

Figure 13:
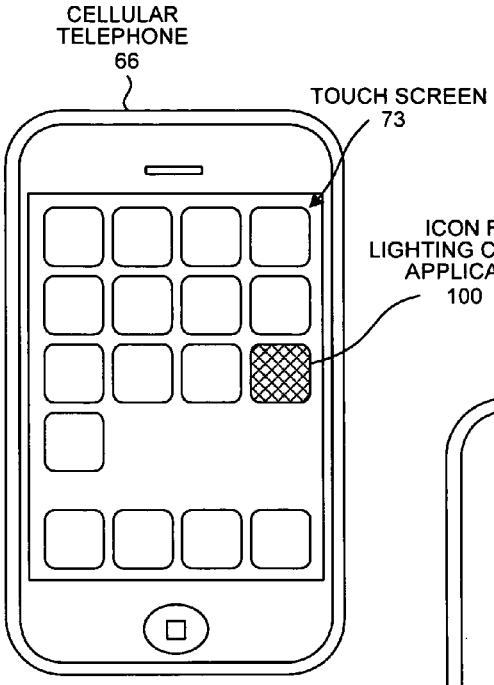
FIG. 13 is a diagram of the front of cellular telephone 66 of system 1 of FIG. 1. An icon 100 for the lighting control application program 74 is displayed on the touch screen of the cellular telephone.
Figure 14:
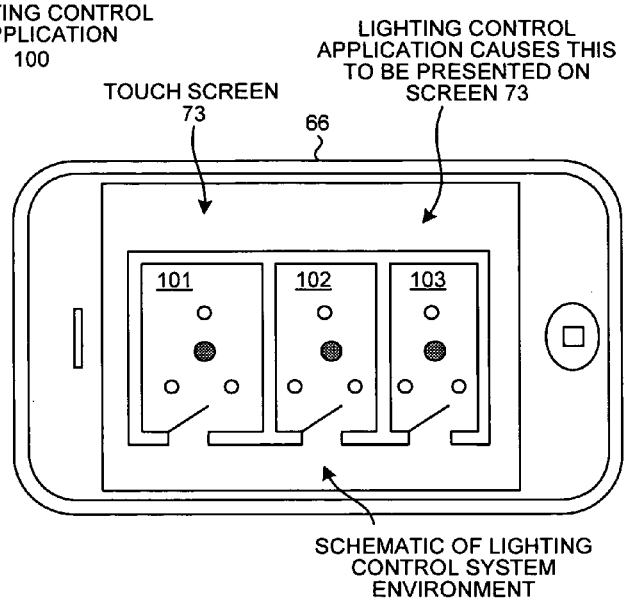
FIG. 14 is a diagram that shows how program 74 responds to user selection of icon 100 of FIG. 13, and causes a top-down schematic diagram of the environment of system 1 to be displayed to the user.

FIG. 13 is an illustration of the front of cellular telephone 66. An 100 icon associated with lighting control program 74 is displayed on screen 73 to the user. The user presses icon 100, thereby launching program 74. As illustrated in FIG. 14, program 74 responds and causes a top-down schematic diagram of the environment of system 1 to be displayed to the user on screen 73. In the present simplified example, the three LPTHWNs involving occupancy detectors 2, 6 and 10 are located in three respective rooms 101, 102 and 103 of a building. Icons representing the occupancy detectors and the fluorescent lamp starter units are displayed. The user can use the represented locations of the icons with respect to the rooms of the building as displayed on screen 73 to identify a correspondence between a particular icon and an actual associated device as installed in the building. In the example of FIG. 14, starter units are represented by smaller unfilled circles, whereas occupancy detectors are represented by larger filled circles.

Figure 15:
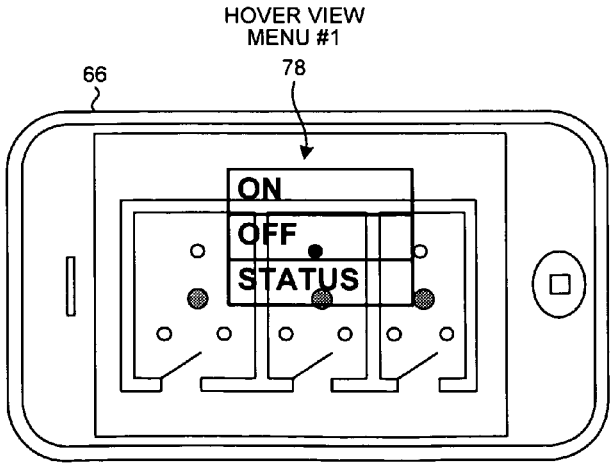
FIG. 15 is a diagram that shows a hover view menu presented to the user for a starter unit.

FIG. 15 is an illustration of a next operation of program 74. If the user slides a finger over the location of one of the icons, then a hover view menu appropriate for the icon appears on the screen. In the present example, the user has slid a finger over the icon for starter unit 8 in the second room. A hover view menu 78 appropriate for a starter unit is therefore made to appear as an overlay over the representation of the icon. Hover view menu 78 has three selectable buttons: an "ON" button, an "OFF" button, and a "STATUS" button.

If the user then slides a finger over the "ON" button and presses, then system 1 functions to turn the lamp controlled by starter unit 8 on. Program 74 causes cellular telephone 66 to make a WiFi 802.11(n) transmission to network master 50. The WiFi transmission is not a transmission of an amount of HTML code, but rather is a relatively short 802.11 frame containing a TCP/IP packet of approximately twenty to thirty bytes. Network master 50 receives the frame and TCP/IP packet. Communications microcontroller 61 handles protocol processing and supplies the data payload of the packet to microcontroller 53. Program 64 executing in microcontroller 53 interprets the data as a command to send a command to occupancy detector 6 to turn on the lamp controlled by starter unit 8. Microcontroller 53 formulates an appropriate communication and transmits it via transceiver 52 and antenna 51 across the 868 MHz wireless link to occupancy detector 6. Occupancy detector 6 receives the command, interprets it, and forms a beacon that includes a command. The command is a command to the addressed starter unit 8 to turn its associated lamp on. Occupancy detector 6 transmits the command to starter unit 8 as part of the next beacon. When starter unit 8 wakes and receives the beacon, starter unit 8 determines from the command in the beacon that it has been commanded to turn on its lamp. Starter unit 8 responds and turns its lamp on using the process illustrated in FIGS. 6-8.

In a similar fashion, a user of cellular telephone 66 can use lighting control program 74 to turn off a designated lamp, or to view status of a designated lamp. In one example, if the "STATUS" button (see FIG. 15) is selected, then a command is sent from cellular telephone 66 to network master 50 to report back status of the identified starter unit or identified occupancy detector. Network master 50 may simply respond to the cellular telephone with status information stored on the network master where that status information was previously collected, and/or the network master can issue a command to the identified starter unit to transmit current status information back in response to the next beacon. Regardless of how the status information is obtained and stored, the lighting control program 74 provides a mechanism for querying the system for status information and for viewing the status information. Network master 50 reports the status information via the WiFi link to the cellular telephone 66 such that program 74 can cause the status information to be displayed to the user.

In one example, each starter unit maintains a count of the number of ignition attempts it makes before its lamp is determined to have been turned on. As a fluorescent lamp ages, the number of such ignition attempts may be seen to increase from one to ten or more. Over time, using the beacons, each occupancy detector queries its starter units one by one for their status information. One starter unit is queried each beacon. The particular starter unit queried transmits back its status information back to the occupancy detector at a predetermined time after the beacon. By this querying mechanism, the occupancy detectors collect information on the number of ignition attempts required to ignite the lamps of their respective starter units, and the occupancy detectors report this collected information back to network master 50. The collected ignition attempt information is stored in network master 50 as part of system statistics information 75. If the user selects the "STATUS" button as mentioned above (see FIG. 15), then an indication of the aging or operation of the lamp associated with the indicated starter unit is retrieved from network master via the WiFi link and is and is displayed to the user on the screen 73 of cellular telephone 66. In one example, if the number of ignition attempts required to ignite the lamp is determined to have exceeded ten attempts, then the STATUS reported back to the user for the indicated starter unit indicates that the lamp has failed or should be replaced.

In the present example, each occupancy detector is a battery-powered device. Each occupancy detector includes an Analog-to-Digital Converter (ADC) that periodically monitors the voltage across its battery. As an example, reference numeral 76 (see FIG. 1) identifies the battery of occupancy detector 2 and reference numeral 77 identifies the ADC that monitors the voltage across the battery. If the battery voltage as monitored falls below a predetermined voltage (for example, 2.4 volts), then occupancy detector 2 reports the low-battery condition back to network master 50 via the 868 MHz LPTHWN. The battery status of the battery of each occupancy detector of system 1 is reported back to network master 50 in this way and is stored in memory 63 as part of the statistics information 75. If the user selects the "STATUS" button when the hover view menu is for an occupancy detector, then an indication of the battery voltage is reported back to cellular telephone 66 and is displayed to the user. In one example, if the battery voltage drops below the predetermined voltage of 2.4 volts, then a message that the battery should be replaced is displayed to the user on screen 73.

In one advantageous aspect, the occupancy detectors and starter units of system 1 are made as inexpensive as possible. They store only a minimal amount of current status information. Memory storage space required to store historical status information and processing resources required to process such historical status information is not provided in the starter units or in the occupancy detectors, but rather is provided in either network master 50 or in cellular telephone 66. Over time, status information is pushed to network master 50 and is collected and stored on the network master in memory 63, thereby reducing the manufacturing costs of the occupancy detectors and starter units. In order to reduce the cost of network master 50, communications microcontroller 61 does not serve web pages and network master 50 does not communicate rich and complex HTML code across its WiFi link. Rather, graphical information used to generate pleasing screen displays is stored in the memory of cellular telephone 66. Similarly, processing resources of the cellular telephone 66 are used to perform statistics processing functions. Processing resources of cellular telephone 66 are used to determine how to render statistics information 75 on screen 73. By realizing as many data storage and data processing functions as possible in cellular telephone 66 as opposed to network master 50, the amount of memory and processing power on network master 50 is reduced thereby reducing manufacturing cost of network master 50. Network master 50 has neither a display nor a keyboard or keypad.

Figure 16:
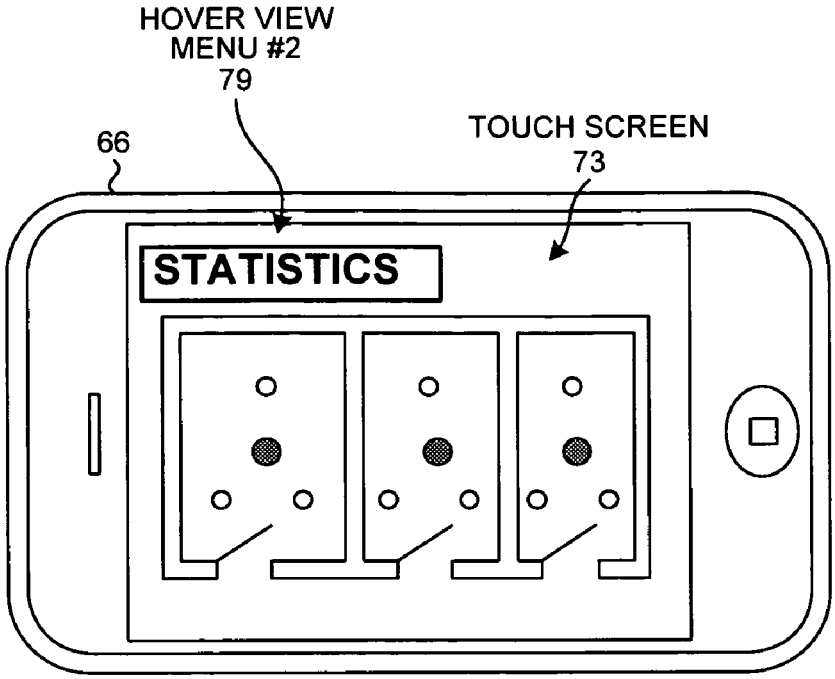
FIG. 16 is a diagram that shows a hover view STATISTICS menu.

FIG. 16 is an illustration of another operation of program 74. If the user slides a finger over a location in the upper left of screen 73, then a hover view menu 79 "STATISTICS" is presented to the user. If the user selects the "STATISTICS" button, then a screen is presented to the user that displays system statistics to the user.

Figure 17:
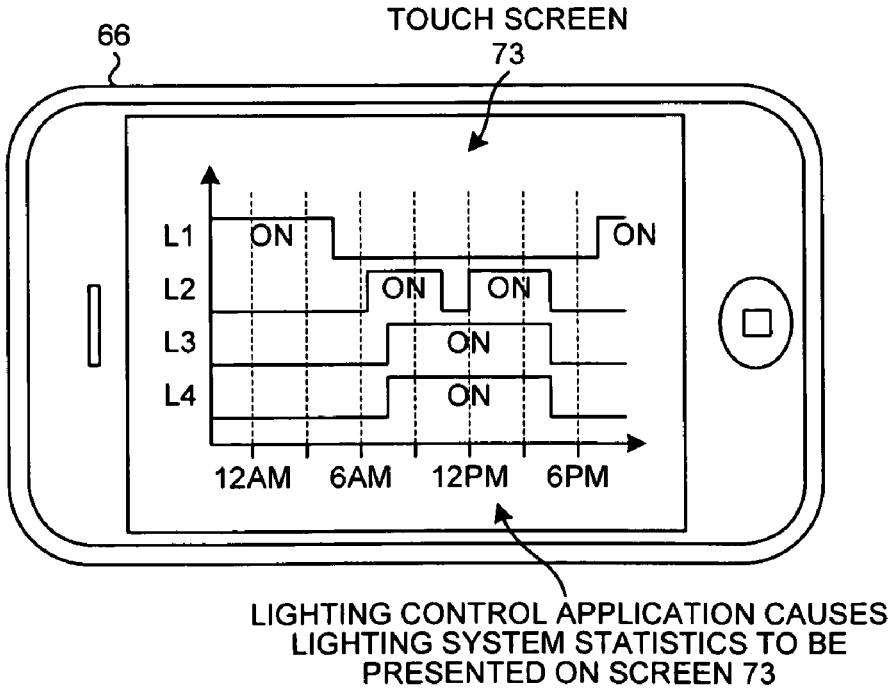
FIG. 17 is a diagram of an example of how lighting control application program 74 can display historical status information to the user.

FIG. 17 is a diagram of one possible statistics screen. The "L1", L2", "L3", and "L4" designations in FIG. 17 indicate "lamp 1", "lamp 2", lamp 3" and "lamp 4". For each lamp, a waveform is presented that shows when the lamp was controlled to be on and when the lamp was controlled to be off. Many types of statistics on lamp usage, and power consumption, and room occupancy can be presented to the user in different formats using selectable hover view menus and screen 73 in this way.

In one operational example, system 1 can be configured to send an alert email automatically upon a particular occurrence. If, for example, microcontroller 53 detects that a lamp requires replacement (for example, due to the lamp requiring more than ten ignition attempts to be turned on) or if microcontroller 53 detects that an occupancy detector's battery requires replacement (for example, due to the battery voltage being detected as being below 2.4 volts), then microcontroller 53 causes communications microcontroller 61 to use its SMTP functionality to generate an email. The email is addressed to the user who uses cellular telephone 66 to read emails. Once composed, the email is communicated via to WiFi router 67. WiFi router 67 receives 802.11 frames containing the email, detects that the SMTP protocol is being used, and in response automatically forwards the email to prespecified email server 72. The email may, for example, contain information on which part of system 1 requires replacement or which part of system 1 requires maintenance. The user can use cellular telephone 66 and a "get email app" to access email server 72 via cellular telephone network 71 and to read the alert email in conventional fashion.

Figure 18:
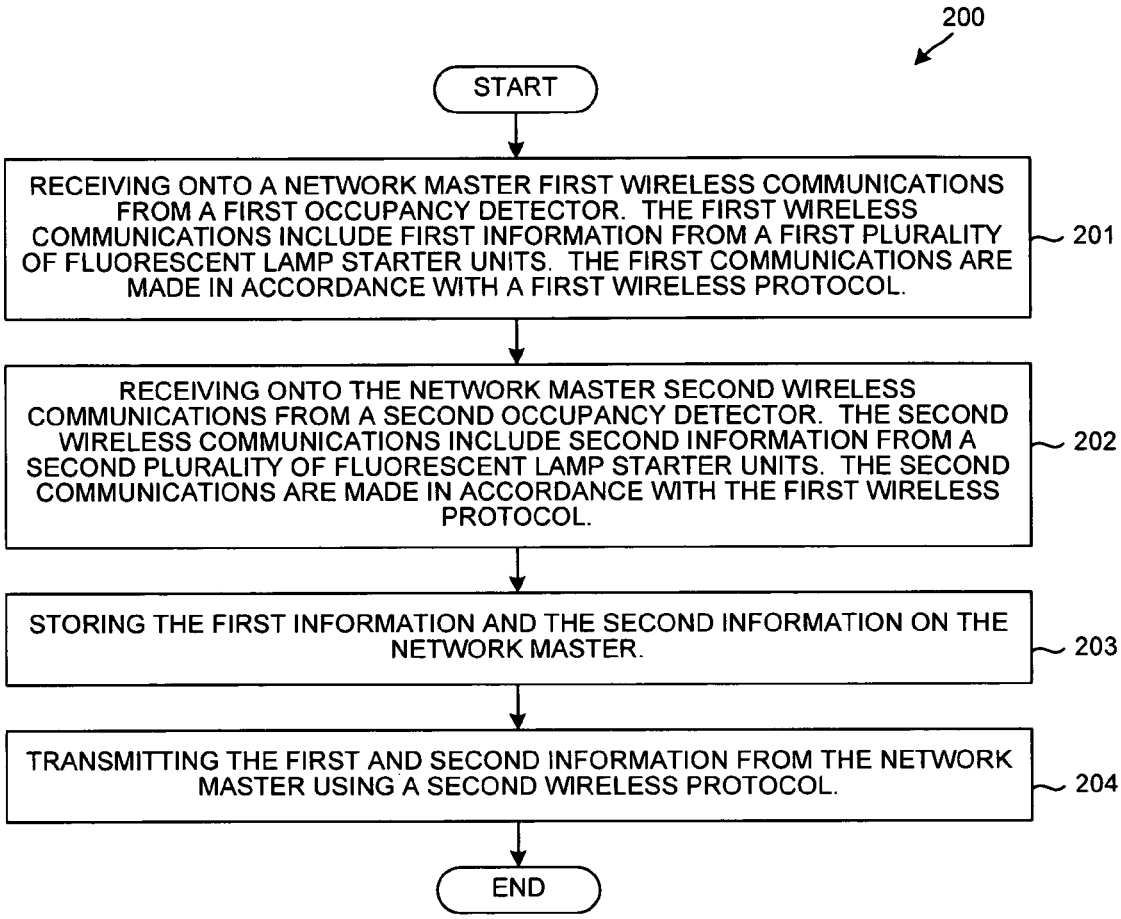
FIG. 18 is a flowchart of a method 200 in accordance with one novel aspect.

FIG. 18 is a flowchart of a novel method 200. In a first step (step 201), first wireless communications are received onto the network master from a first occupancy detector. The first wireless communications include first information from a first plurality of fluorescent lamp starter units. The first communications are made using a first wireless protocol. In one example, the first wireless protocol is the 868 MHz FSK low-power time-hopping wireless network (LPTHWN) protocol described above in connection with FIG. 1. The first occupancy detector is occupancy detector 2 of FIG. 1. The first plurality of fluorescent lamp starter units is starter units 3-5 of FIG. 1.

In a second step (step 202), second wireless communications are received onto the network master from a second occupancy detector. The second wireless communications include second information from a second plurality of fluorescent lamp starter units. The second communications are made using the first wireless protocol. In one example, the second occupancy detector is occupancy detector 6 of FIG. 1. The second plurality of fluorescent lamp starter units is starter units 7-9 of FIG. 1.

In a third step (step 203), the first information and the second information is stored on the network master. In one example, the first information and the second information is stored in memory 63 of network master 50 of FIG. 1.

In a fourth step (step 204), the first and second information is transmitted from the network master using a second wireless protocol. In one example, the first and second information is transmitted in accordance with the WiFi 802.11(n) standard from network master 50 to cellular telephone 66. The first and second information is transmitted to cellular telephone 66 in response to a request for this information received onto network master 50 from cellular telephone 66. The lighting control program 74 executing on cellular telephone 66 receives the first and second information and presents it as appropriate to the user on touch screen 73 of cellular telephone 66.

Although certain specific embodiments are described above for instructional purposes, the teachings of this patent document have general applicability and are not limited to the specific embodiments described above. Rather than, or in addition to, network master 50 being wirelessly coupled to a LAN via a wireless router using the second RF communication protocol (for example, 802.11(n)), network master 50 in some embodiments is also connected directly to router 67 by a wired Ethernet connection involving an Ethernet cable. Such a LAN-connected network master 50 can be communicated with and controlled remotely via any suitable computer that is connected to the Internet. Such a network master 50 may, for example, be made to serve web pages and can be interacted with via the web pages using a web browser executing on an Internet-connected computer. The email alerts described above can also received on this computer. Accordingly, various modifications, adaptations, and combinations of various features of the described embodiments can be practiced without departing from the scope of the invention as set forth in the claims.

What is claimed is:

1. A method comprising:

(a) receiving onto a device first wireless communications from a first occupancy detector, wherein the first wireless communications include first information received from a first plurality of fluorescent lamp starter units, and wherein the first wireless communications are transmitted from the first occupancy detector in accordance with a first wireless protocol;

(b) receiving onto the device second wireless communications from a second occupancy detector, wherein the second wireless communications include second information received from a second plurality of fluorescent lamp starter units, and wherein the second wireless communications are transmitted from the second occupancy detector in accordance with the first wireless protocol;

(c) storing the first information and the second information on the device; and (d) transmitting the first and second information from the device using a second wireless protocol.

2. The method of claim 1, further comprising:

(e) transmitting from the device a wireless communication to the first occupancy detector, wherein the transmission of (e) is in accordance with the first wireless protocol, and wherein the transmission of (e) includes a command for one of the fluorescent lamp starter units of the first plurality of fluorescent lamp starter units.

3. The method of claim 1, wherein the transmitting of (d) is a transmitting of the first and second information directly from the device to a cellular telephone, and wherein the second wireless protocol is not a cellular telephone protocol used to communicate voice information from the cellular telephone to any cellular telephone network.

4. The method of claim 1, wherein the first occupancy detector controls the first plurality of fluorescent lamp starter units to turn off a first plurality of fluorescent lamps associated with the first plurality of fluorescent lamp starter units, wherein the second occupancy detector controls the second plurality of fluorescent lamp starter units to turn off a second plurality of fluorescent lamps associated with the second plurality of fluorescent lamp starter units, wherein the first occupancy detector does not control the second plurality of fluorescent lamp starter units, and wherein the second occupancy detector does not control the first plurality of fluorescent lamp starter units.

5. The method of claim 1, further comprising:

(e) automatically generating an email on the device and communicating the email from the device to an email server, wherein the device generates and communicates the email in (e) in response to the device detecting a predetermined condition.

6. The method of claim 5, wherein the device determines that the email should be generated and communicated in (e) based at least in part on information received from one of the first plurality of fluorescent lamp starter units or from one of the second plurality of fluorescent lamp starter units.

7. The method of claim 5, wherein the predetermined condition is a low battery condition of a battery of an occupancy detector.

8. The method of claim 5, wherein the predetermined condition is a fluorescent lamp condition, wherein the fluorescent lamp is a lamp controlled by one of the first and second pluralities of fluorescent lamp starter units.

9. The method of claim 1, further comprising:

(e) receiving onto the device a wireless communication directly from a cellular telephone, wherein the transmitting of (d) occurs in response to the communication of received in (e), and wherein the wireless communication received in (e) is communicated in accordance with the second wireless protocol.

10. The method of claim 1, wherein the first and second wireless protocols are Radio Frequency (RF) communication protocols.

11. A device comprising:

an amount of memory;

a first Radio Frequency (RF) transceiver that receives RF communications from a plurality of RF-enabled occupancy detectors, wherein status information received from the plurality of RF-enabled occupancy detectors via the RF communications is stored in the amount of memory, and wherein the RF communications received from the RF-enabled occupancy detectors are communicated in accordance with a first RF communication protocol; and a second RF transceiver that transmits RF communications directly to a wireless mobile communication device, wherein the RF communications include the status information, and wherein the RF communications transmitted are communicated in accordance with a second RF communication protocol.

12. The device of claim 11, wherein the wireless mobile communication device is a cellular telephone.

13. The device of claim 11, further comprising:

an email generating mechanism that automatically generates an email and causes the email to be transmitted from the second RF transceiver in accordance with the second RF communication protocol.

14. The device of claim 11, wherein the second RF communication protocol is not a cellular telephone protocol used to communicate voice information from the wireless mobile communication device to any cellular telephone network.

15. The device of claim 13, wherein the email is automatically generated if the status information received from the plurality of RF-enabled occupancy detectors indicates a predetermined lamp wear condition.

16. The device of claim 13, wherein the email is automatically generated if the status information received from the plurality of RF-enabled occupancy detectors indicates a predetermined low battery voltage condition.

17. The device of claim 11, wherein the status information includes information indicative of when a fluorescent lamp was on.

18. The device of claim 11, wherein the status information includes information indicative of a condition of a battery of an occupancy detector.

19. A device comprising:

means for receiving first RF communications from a plurality of RF-enabled occupancy detectors, wherein status information received from the plurality of RF-enabled occupancy detectors via the first RF communications is stored in a memory on the device, and wherein the first RF communications received from the RF-enabled occupancy detectors are communicated in accordance with a first wireless protocol; and means for transmitting second RF communications directly from the device to a wireless mobile communication device, wherein the second RF communications transmitted to the wireless mobile communication device include the status information, wherein the second RF communications are communicated in accordance with a second wireless protocol, and wherein the second wireless protocol is not a cellular telephone protocol used by the wireless mobile communication device to communicate voice information to any cellular telephone network.

20. The device of claim 19, further comprising:

means for automatically generating an email, wherein the email is then communicated from the means for transmitting in accordance with the second wireless protocol.

* * * * *